US009208985B2

(12) United States Patent
Camara et al.

(10) Patent No.: US 9,208,985 B2
(45) Date of Patent: Dec. 8, 2015

(54) FRICTION DRIVEN X-RAY SOURCE

(75) Inventors: Carlos Camara, Venice, CA (US); Mark G Valentine, Marina Del Rey, CA (US)

(73) Assignee: Tribogenics, Inc., Los Angeles, CA (US)

( * ) Notice: Subject to any disclaimer, the term of this patent is extended or adjusted under 35 U.S.C. 154(b) by 533 days.

(21) Appl. No.: 13/523,551

(22) Filed: Jun. 14, 2012

(65) Prior Publication Data

US 2013/0336460 A1 Dec. 19, 2013

(51) Int. Cl.

| | |
|---|---|
| ***H05G 2/00*** | (2006.01) |
| ***H01J 35/02*** | (2006.01) |
| ***H01J 35/16*** | (2006.01) |

(52) U.S. Cl.

CPC ..... *H01J 35/02* (2013.01); *H01J 35/16* (2013.01); *H05G 2/00* (2013.01)

(58) Field of Classification Search

CPC ..... H01J 35/02; H01J 35/16; H05G 2/00
USPC ..... 378/121–141
See application file for complete search history.

(56) References Cited

U.S. PATENT DOCUMENTS

| | | | |
|---|---|---|---|
| 2,810,077 | A | 10/1957 | Gale |
| 3,612,918 | A | 10/1971 | Willutzki |
| 4,789,802 | A | 12/1988 | Miyake |
| 4,990,813 | A | 2/1991 | Paramo |
| 5,150,398 | A | 9/1992 | Nishioka et al. |
| 5,665,969 | A | 9/1997 | Beusch |
| 6,476,406 | B1 | 11/2002 | Struye et al. |
| 6,493,423 | B1 | 12/2002 | Bisschops |
| 6,668,039 | B2 | 12/2003 | Shepard et al. |
| 6,925,151 | B2 | 8/2005 | Harding et al. |
| 7,060,371 | B2 | 6/2006 | Akiyama et al. |
| 7,596,242 | B2 | 9/2009 | Breed et al. |
| 2003/0142789 | A1 | 7/2003 | Harding et al. |
| 2005/0207536 | A1 | 9/2005 | Shiraishi |
| 2006/0114964 | A1 | 6/2006 | Dishaw et al. |
| 2009/0050847 | A1 | 2/2009 | Xu et al. |
| 2011/0130613 | A1 | 6/2011 | Putterman et al. |
| 2011/0147606 | A1 | 6/2011 | Bragagna et al. |

FOREIGN PATENT DOCUMENTS

| | | | |
|---|---|---|---|
| FR | 2894107 | A1 | 6/2007 |
| SU | 1149331 | A1 | 4/1985 |

OTHER PUBLICATIONS

Hird et al., A truboelectric x-ray source, Mar. 28, 2011, Applied Phusics Letters, 98, 133501-1-3.*

Stefan Kneip, A stroke of X-ray, May 26, 2011, Nature, vol. 473, 455-456.*

(Continued)

*Primary Examiner* — Glen Kao
*Assistant Examiner* — Dani Fox
(74) *Attorney, Agent, or Firm* — Klein, O'Neill & Singh, LLP

(57) ABSTRACT

A high energy radiation generator utilizes sliding friction in a low pressure environment to generate high energy radiation, for example x-rays. The sliding friction may be generated by sweeping one material against a second material, for example rotating a surface of a rotor against a membrane, in the presence of an electron target, which may be one of the first material or the second material, or a different material.

27 Claims, 15 Drawing Sheets

(56) References Cited

OTHER PUBLICATIONS

Klyuev et al., "The effect of air pressure on the parameters of x-ray emission accompanying adhesive and cohesive breaking solids", Sov. Phys. Tech. Phys., vol. 34, Mar. 1989, pp. 361-364.
Nakayama et al., "Triboemission of charged particles and photons from solid surfaces during frictional damage", Journal of Physics D. Applied Physics, vol. 25, No. 2, Feb. 14, 1992, pp. 303-308.
Nishitani et al., "STM tip-enhanced photoluminescence from porphyrin film", Surface Science, North-Holland Publishing Co., vol. 601, No. 17, Aug. 23, 2007, pp. 3601-3604.
Ohara et al., "Light emission due to peeling of polymer films from various substrates", Journal of Applied Polymer Science, vol. 14, No. 8, Aug. 1, 1970, pp. 2079-2095.
International Search Report on related PCT Application No. PCT/US2013/045473 from International Searching Authority (KIPO) dated Oct. 16, 2013.
Written Opinion on related PCT Application No. PCT/US2013/045473 from International Searching Authority (KIPO) dated Oct. 16, 2013.
Examination Report on European Application No. 09711141.3 from the European Patent Office (EPO) dated Oct. 9, 2014.
Kluev et al., "Gas-Discharge Phenomena, Accompanying the Process of Breaking an Adhesion Contact in Vacuum", IAS Annual Meeting, Oct. 2-6, 1977, Los Angeles, CA, USA, Jan. 1, 1997, pp. 596-598.
Extended European Search Report (EESR) on European Application No. 13804307.0 from the European Patent Office (EPO) dated Oct. 22, 2015.

* cited by examiner

FRICTION DRIVEN X-RAY SOURCE

BACKGROUND OF THE INVENTION

The present invention relates generally to generation of high-energy radiation, and more particularly to generation of high energy radiation utilizing frictional contacts.

High energy radiation is used in a variety of ways. For example, X-rays may be used for medical or other imaging applications, crystallography related applications including material analysis, or in other applications.

X-rays are generally generated by electron braking (bremmstrahlung) or inner shell electron emission within a material. Historically, other than through natural phenomena, x-rays generally have been generated by using a high voltage power supply to accelerate electrons into a material, such as a metal, with a small proportion of the electrons causing x-rays. Acceleration of the electrons to generate a useful quantity of x-rays, however, generally requires expenditure of significant power, particularly when considering the small percentage of such electrons which actually result in x-ray emissions.

X-rays may also be generated by changes in mechanical contact between materials in a controlled environment, for example through the unpeeling of pressure sensitive adhesive tape or mechanical contact of some materials in an evacuated chamber. However, utilization of such methods to provide a sufficient intensity of x-rays to be commercially useful, and doing so outside of a laboratory environment, may be difficult.

BRIEF SUMMARY OF THE INVENTION

Aspects of the present invention provide for generation of high energy radiation by way of sliding frictional contact between two surfaces, in proximity to an electron target, in a housing providing a low pressure environment, with the two surfaces of such dissimilar material so as to provide for tribocharging, with the sliding frictional contact on at least part of one of the surfaces at most intermittent over time so as to allow for electrical discharge. In some embodiments one of the surfaces is an electrical insulator and the other surface is a metallic material. In some embodiments the metallic material is the electron target. In some embodiments another metallic surface is the electron target. In some embodiments the other metallic surface is at a predefined distance from one of the two surfaces. In some embodiments the sliding frictional contact is repetitively intermittent or between a moving surface and a stationary surface.

One aspect of the invention provides a device useful in generating high energy radiation, comprising: a housing including at least one port for at least partially evacuating the housing of atmosphere, at least a portion of the housing being substantially transparent to high energy radiation; a first object within the housing; and a second material within the housing, the second material insulated from ground; at least portions of the first object or at least portions of the second material moveable relative to the other so as to produce a sliding frictional contact between the first material and the second material.

Another aspect of the invention provides a high energy radiation generating device, comprising: a housing normally sealable so as to provide a controlled fluid pressure environment; a membrane mounted within the housing; and a rotor rotationally mounted within the housing such that at least a portion of the rotor may slide against at least a portion of the membrane; with at least one of the portion of the membrane and the portion of the rotor include a material insulated from ground and the other of the portion of the membrane and the portion of the rotor include an electrically conductive material.

Another aspect of the invention provides a method of generating high energy radiation, comprising: brushing a first material against an area of a surface of a second material, the first material and the second material being different materials, the second material being insulated from ground; in a low pressure environment, removing the first material from the area of the surface of the second material in proximity to an electron target comprising a metal surface.

These and other aspects of the invention are more fully comprehended upon review of this disclosure.

DETAILED DESCRIPTION

Embodiments of the invention provide a device useful in generation of high energy radiation. In some embodiments the device is a high energy radiation generator including a material and an object. In the presence of an electron target, the object is configured to sweep or brush against a surface of the material, resulting in sliding frictional contact between the material and the object, with the sliding frictional contact over at least a portion of the surface of the material discontinuous over time. The electron target is in many embodiments a metal or a matal alloy, and the electron target may be part of the object, for example on a surface of the object. The material and the object are in a controlled fluid pressure environment, generally a low pressure environment. The controlled fluid pressure is in many embodiments less than one atmosphere, in some embodiments is at or about 100 mTorr, in some embodiments is less than 100 mTorr, in some embodiments is less than 50 mTorr, in some embodiments is less than 1 mTorr, and in some embodiments is less than 0.001 mTorr.

Figure 1:
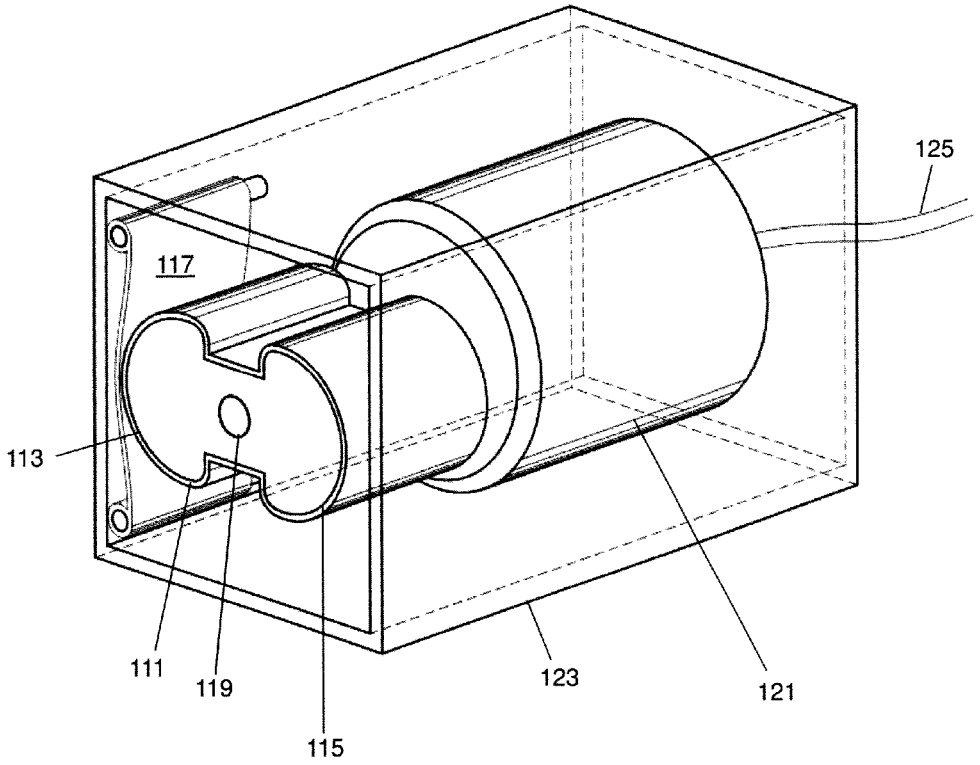
FIG. 1 illustrates a high energy radiation generator in accordance with aspects of the invention.

FIG. 1 illustrates a high energy radiation generator in accordance with aspects of the invention. In the embodiment of FIG. 1, a rotor 111 rotates in a low pressure environment of a housing 123. As illustrated in FIG. 1, the rotor includes a first lobe 113 and a second lobe 115. A surface of the first lobe and the second lobe include at least one metal, for example in elemental or alloyed form, with in various embodiments at least one metal of each lobe being different metals or in different metal alloys. The first and second lobes are on opposing sides of a spindle 119 connected to the rotor. Rotation of the spindle, for example by way of rotation of a motor 121 to which the spindle is coupled, causes rotation of the rotor.

A membrane 117, generally electrically isolated from ground, and formed of an electrical insulator in some embodiments, is approximate the rotor, with the membrane positioned with respect to the rotor such that the lobes brush against the membrane during rotation of the rotor. While the lobes brush against the membrane, the lobes and the membrane are in sliding frictional contact. Accordingly, as the spindle rotates, each lobe approaches the membrane, brushes against a portion of the membrane, resulting in sliding frictional contact between the lobe and the portion of the membrane, and recedes away from the membrane. In the low pressure atmosphere provided within the housing, the sliding frictional contact, or perhaps more correctly the sliding frictional contact over an area followed by lack of the contact over the area, results in emission of high energy radiation, for example x-rays.

The membrane and the rotor are both located in the housing 123 having an at least partially evacuated atmosphere. In many embodiments the housing includes at least a portion allowing for substantial or significant escape of high energy radiation, for example x-rays, from the housing. In some embodiments the portion of the housing allowing for escape of the high energy radiation is a portion of the housing substantially transparent to x-rays, for example a window in the housing, and in many embodiments the window may be located proximate to the membrane and/or substantially parallel to the membrane. In some embodiments the window is structured to collimate beams of the high energy radiation. In many embodiments the housing will include at least one port to allow for control of presence of gasses in the housing, for example by way of evacuation of gasses from the housing. In addition, in many embodiments the housing will also contain a getter material to assist in maintaining a low pressure environment within the housing, particularly considering potential outgassing resulting from abrading contact between the rotor and the membrane. Also, in the embodiment illustrated in FIG. 1, the housing has a cuboid shape, but in various embodiments the housing may be of a different shape. Additionally, as illustrated in FIG. 1, the motor is within the housing. In alternative embodiments the motor is outside the housing, with for example the spindle passing through a wall of the housing.

In some embodiments portions of the lobes which are in sliding frictional contact with the membrane have a surface of one metal or metal alloy. Other portions of the lobes, near the portions which are in sliding frictional contact with the membrane, and expected to be near the membrane when the lobe loses contact with the membrane, have a surface of another metal or metal alloy.

In some embodiments a spooled membrane is utilized. For example, in some embodiments the membrane is coupled to posts which may be spools, with the membrane having an excess length, allowing for unspooling of unused portions of the membrane, for example in the event of wear of portions of the membrane due to sliding frictional contact with the rotor.

Figure 2:
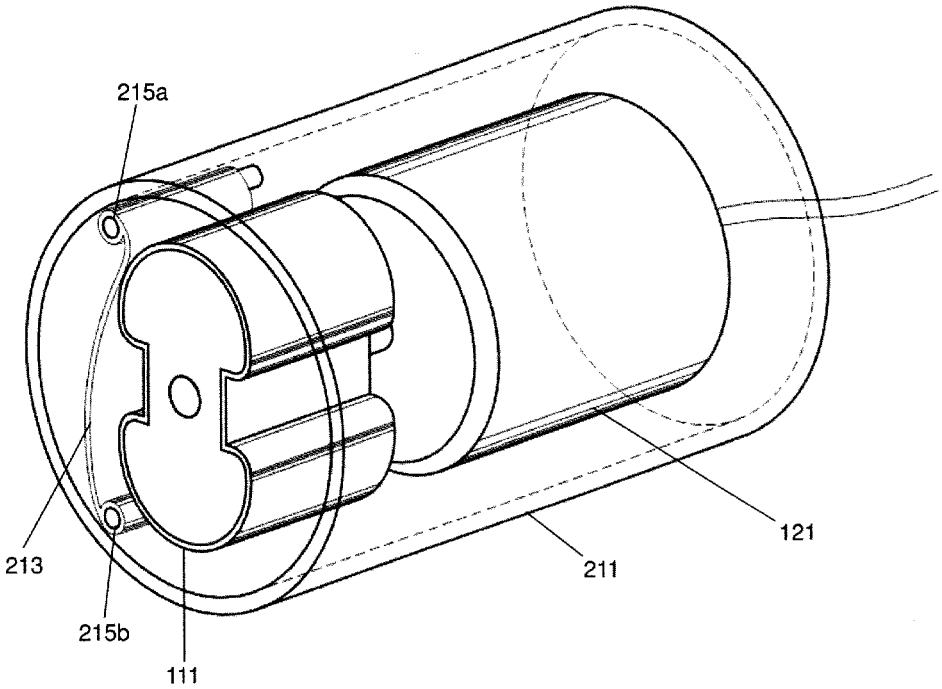
FIG. 2 illustrates further a high energy radiation generator in accordance with aspects of the inventions.

FIG. 2 illustrates a further high energy radiation generator in accordance with aspects of the invention. The further high energy radiation generator is similar to the device of FIG. 1, and so includes the rotor 111 of the device of FIG. 1, which is caused to rotate by the motor 121, with lobes of the rotor brushing against a membrane 213 of a membrane. As in the source of FIG. 1, the rotor, membrane, and motor are within a housing 211 having an at least partially evacuated atmosphere. The housing 211, however, has a cylindrical shape. The use of a cylindrical housing may be beneficial, for example, as the cylindrical shape provides for contact points for posts 215*a,b* between which the membrane may be stretched, while still providing clearance behind the membrane for stretching and/or extension of the membrane due to contact with the lobes of the rotor.

Figure 3:
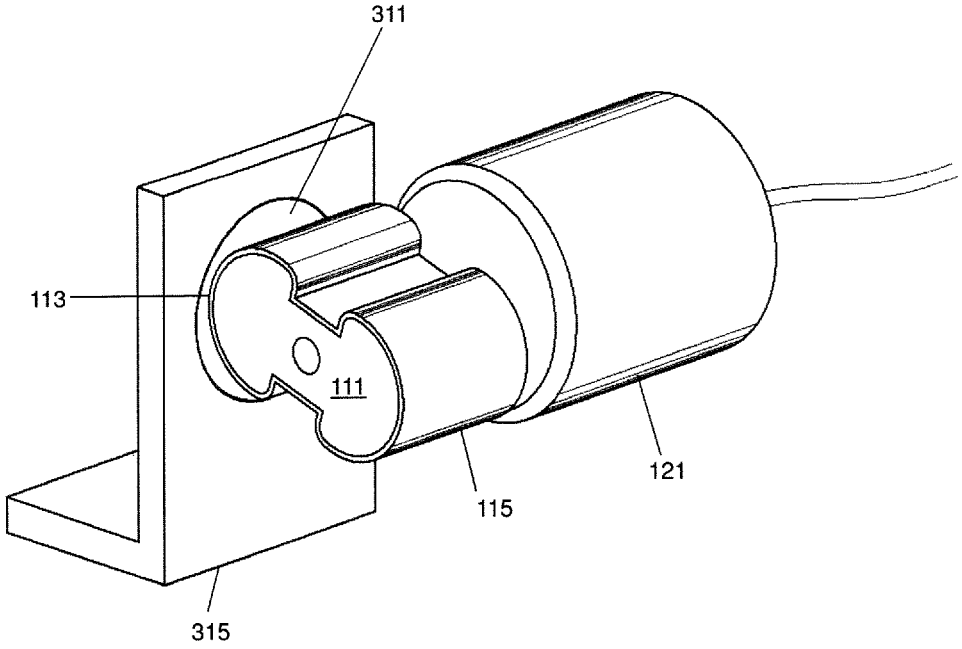
FIG. 3 illustrates portions of a further high energy radiation generator in accordance with aspects of the inventions.

FIG. 3 illustrates portions of a further embodiment similar o the embodiment of FIG. 1. In the embodiment of FIG. 3, the motor 121 causes rotation of the rotor 111 having opposing lobes 113, 115 as discussed with respect to FIG. 1. In operation, rotation of the rotor results in the lobes brushing against a contact surface 311 mounted in a bracket 315. The contact surface 311, therefore, may take the place of the membrane of the device of FIG. 1.

Figure 4:
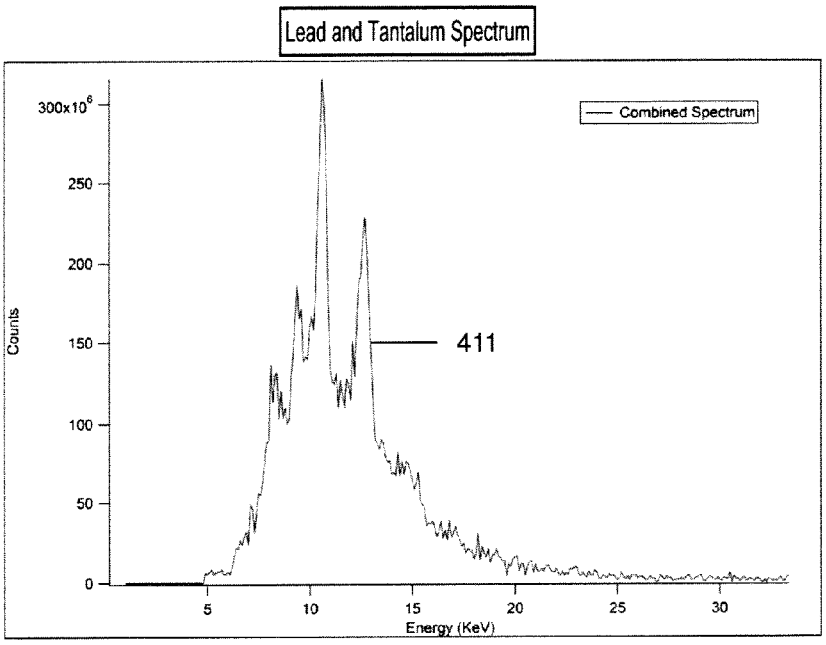
FIG. 4 is a chart showing spectrum of energy generated by a device such as the device of FIG. 1.
Figure 5:
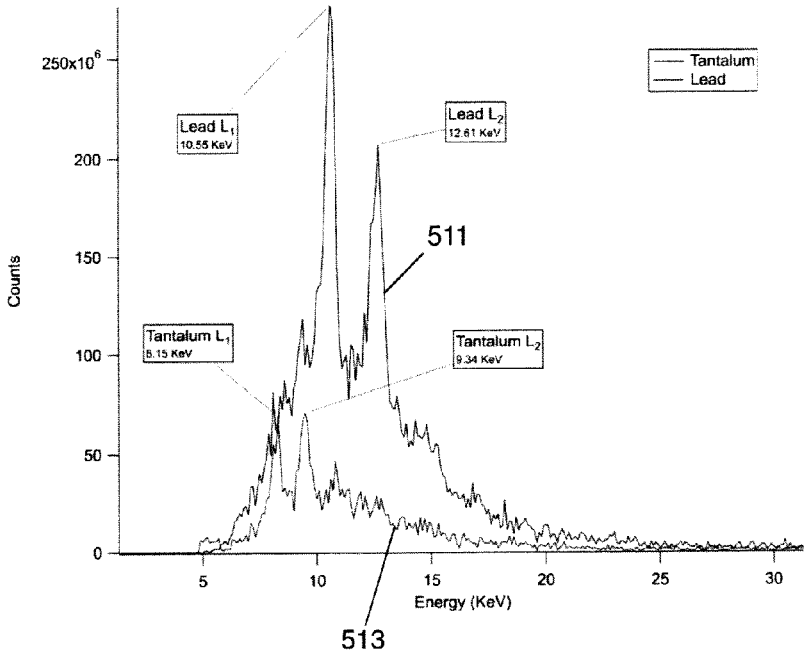
FIG. 5 is a chart showing components of energy generated with respect to different lobes of the device such as the device of FIG. 1.

FIG. 4 is a chart showing spectrum of high energy radiation 411 generated by operation of a device such as the device of FIG. 1, with one of the lobes having a surface including lead and the other of the lobes having a surface including tantalum. FIG. 5 shows a similar chart, with separate indications of high energy radiation emissions 511 due to interaction of the lead including lobe and the contact surface and high energy radiation emissions 513 due to interaction of the tantalum including lobe and the contact surface, with the separation of the emissions calculated based on time of emission.

Figure 6:
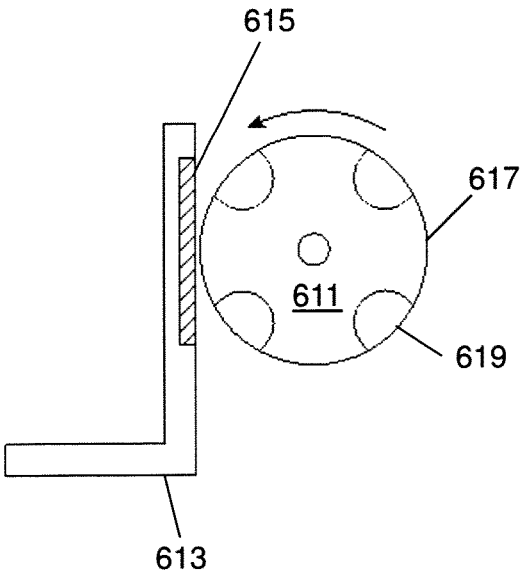
FIG. 6 illustrates portions of a further high energy radiation generator in accordance with aspects of the inventions.

FIG. 6 illustrates portions of a further embodiment similar to the embodiment of FIG. 1. The portions illustrated include a rotor and a contact surface, which would generally be in a housing such as the housing of FIG. 1, with a drive system to drive rotation of the rotor. In the embodiment of FIG. 6, a rotor 611 includes a plurality of lobes, for example four lobes including a lobe 617, separated by separations, for example a separation 619 adjacent to the lobe 617. The rotor is positioned such that rotation of the rotor results in the lobes brushing against a contact surface 615. As illustrated in FIG. 6, the contact surface is part of or mounted in a bracket 613. In some embodiments the separations are gaps devoid of material. In some embodiments the separations are filled with a material different than that of the lobes, or different than that of material on surfaces of the lobes. The materials on the surfaces of the lobes, for example may include a metal or metal alloy, and the material of the contact surface may be an electrically insulating material.

Figure 7:
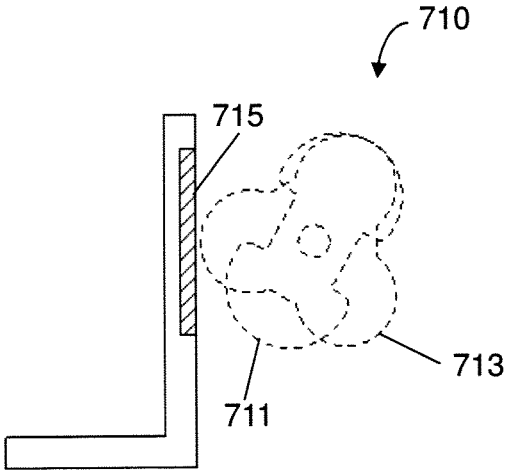
FIG. 7 illustrates portions of a further high energy radiation generator in accordance with aspects of the inventions.

FIG. 7 illustrates portions of a further embodiment similar to the embodiment of FIG. 1, with the portions illustrated being the same as in FIG. 6. In the embodiment of FIG. 7, a rotor structure 710 is formed of multiple rotors stacked with respect to one another. A first rotor 711 includes two opposing lobes. A second rotor 713 includes three lobes, with each of the three lobes a having a central axis 120 degrees apart. The rotor structure is positioned such that the lobes brush against a contact surface 715. The lobes of the rotor include a metal, and the contact surface includes an electrical insulator, or vice versa.

Figure 8:
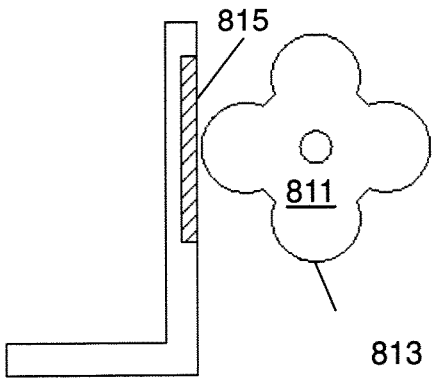
FIG. 8 illustrates portions of a further high energy radiation generator in accordance with aspects of the inventions.
Figure 9:
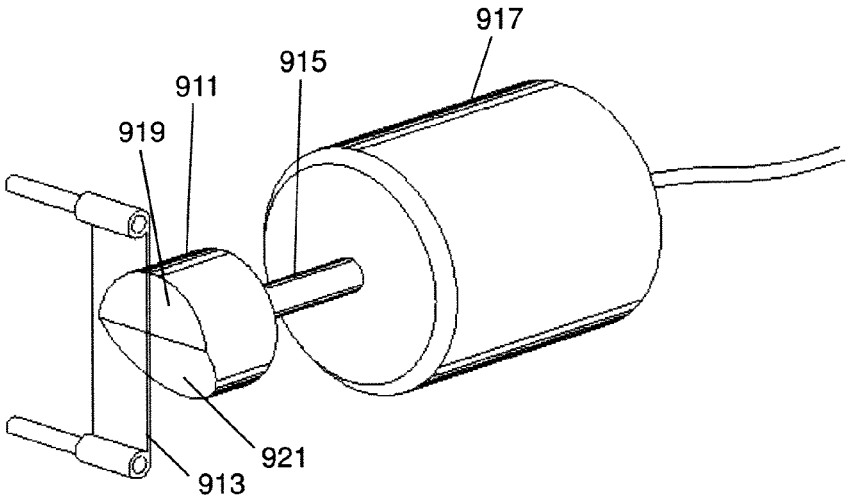
FIG. 9 illustrates portions of a further high energy radiation generator in accordance with aspects of the inventions.

FIG. 8 illustrates portions of a further embodiment similar to the embodiment of FIG. 1, with the portions illustrated being the same as in FIG. 6. In the embodiment of FIG. 8, a rotor 811 has four lobes, for example lobe 813, separated by gaps devoid of material. The rotor is positioned such that the lobes brush a contact surface 815. As with other embodiments, either the lobes or the contact surface are of a metal or an electrically insulating material, with the other being the reverse.

FIG. 8 illustrates portions of a further embodiment in accordance with aspects of the invention. The portions illustrated in FIG. 8 are in most embodiments within a housing providing for a controlled fluid pressure environment, a less than atmospheric pressure environment in most embodiments.

In FIG. 8, a membrane 913 is in contact with a portion of a face 919 of a rotor 911. The rotor is coupled by a spindle 915 to a motor to cause rotation of the rotor, although in various embodiments other drive systems may be used to cause rotation of the rotor. The membrane and the portion of the face in contact with the membrane are generally perpendicular to an axis of rotation of the rotor, which in some embodiments coincides with an axis of the spindle. The membrane is an electrically insulating material in most embodiments, and may be of a polymeric material in some embodiments. In most embodiments the membrane, or at least portions of the membrane in contact with the rotor, are otherwise insulated from ground. The portion of the face of the rotor in contact with the membrane in most embodiments is metallic, including a metal or a metal alloy.

Figure 10:
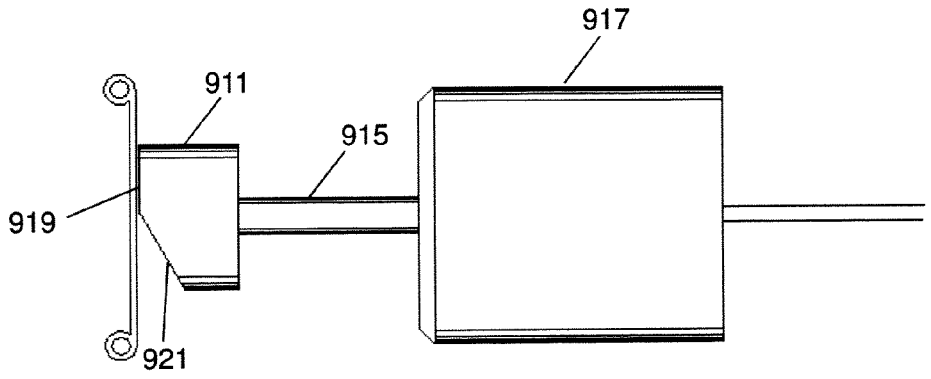
FIG. 10 illustrates a side view of part of the device of FIG. 9.

The face of the rotor includes a surface discontinuity, with the surface discontinuity in the form of a ramp 921 sloping away from the portion of the face in contact with the membrane. In operation, rotation of the rotor results in the portion of the face of the rotor in contact with the membrane sweeping across areas of the surface of the membrane. For areas of the surface of the membrane, contact between the rotor and the membrane is intermittent, as the ramp on the face of the rotor generally does not contact the membrane, as may be seen for example in the corresponding side view of FIG. 10. The ramp includes a metallic surface, and may generally serve as an electron target in the generation of high energy radiation. The metallic surface may be of a different metal or metal alloy than that of the portion of the face of the rotor in contact with the membrane. The ramp serves as an electron target for electric discharge of triboelectric charge generated by sliding frictional contact between the rotor and the membrane, selection of different metal surfaces for the ramp may be beneficial determining characteristics of the generated high energy radiation.

Figure 11:
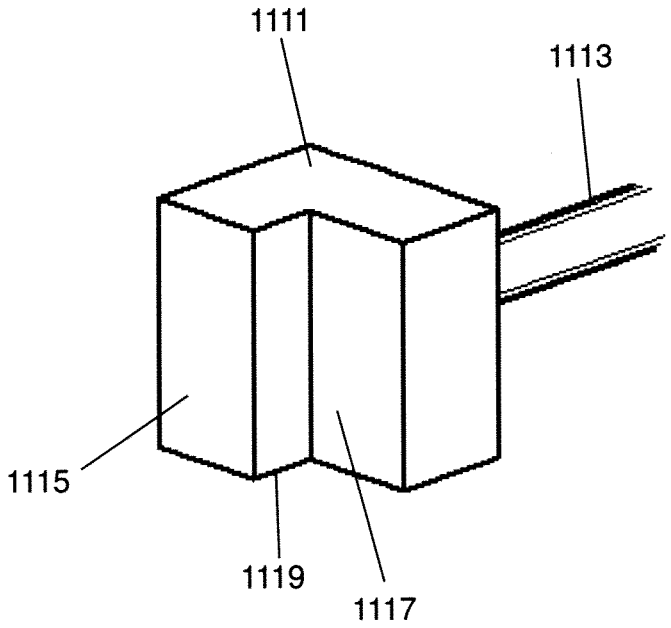
FIG. 11 illustrates a further rotor for use in the device of FIG. 9.

FIG. 11 illustrates a further rotor 1111 in accordance with aspects of the invention, with a spindle 1113 extending from a rear of the rotor to indicate an axis of rotation for the rotor. The rotor includes a contacting surface 1115 on a face of the rotor. The contacting surface is intended generally to be in sliding frictional contact with a membrane as the rotor rotates during operation of a device including the rotor. The contacting surface is metallic in most embodiments.

The face of the rotor includes a stair step, with a recessed portion of the face forming a ledge, a surface of the ledge 1117 connected to the contacting surface by a riser 1119. The surface of the ledge is metallic. The surface of the ledge is believed to serve as an electron target in the generation of high energy radiation during operation of the device, and indeed may be the sole target, and accordingly characteristics of generated high energy radiation may be selected based on selection of various metals for the surface of the ledge. In addition, various embodiments may have differing distances between surface levels of the contacting surface and the ledge surface, a distance which may be considered to be a height of the riser. In such various embodiments differing distances may give rise to differing magnitudes of generated high energy radiation for the same surface material for the ledge.

Figure 12:
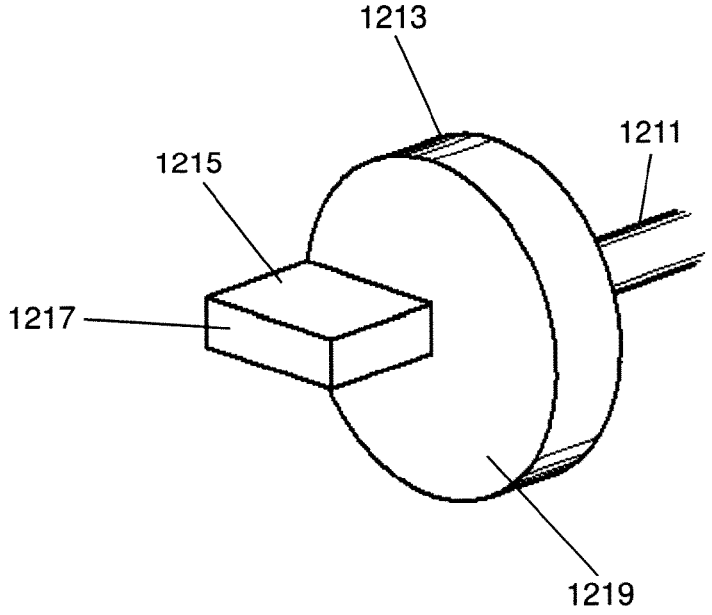
FIG. 12 illustrates a still further rotor for use with the device of FIG. 9.

FIG. 12 illustrates a further rotor in accordance with aspects of the invention, with a spindle 1211 extending from a rear of the rotor to indicate an axis of rotation for the rotor. The rotor of FIG. 12 includes a base 1213 in cylindrical form. A surface 1219 of the base faces away from a spindle 1211 extending from a rear of the base. A sweeper 1215, shown in the form of a rectangular box, protrudes from the base, and includes a forward surface 1217 most distal from the base. The forward surface forms a sweeper, intended to frictionally sweep across portions of a membrane during operation of a device including the rotor, during which the rotor rotates.

The forward surface in most embodiments is metallic. The surface 1219 of the base is also metallic, but may be of a different metal or metal alloy than that of the forward surface. As with the embodiment of FIG. 11, the surface of the base is believed to serve as an electron target during operation of the device, with electrons sourced as a result of discharge of triboelectric charging resulting from sliding frictional contact between the membrane and the forward surface of the rotor.

Figure 13:
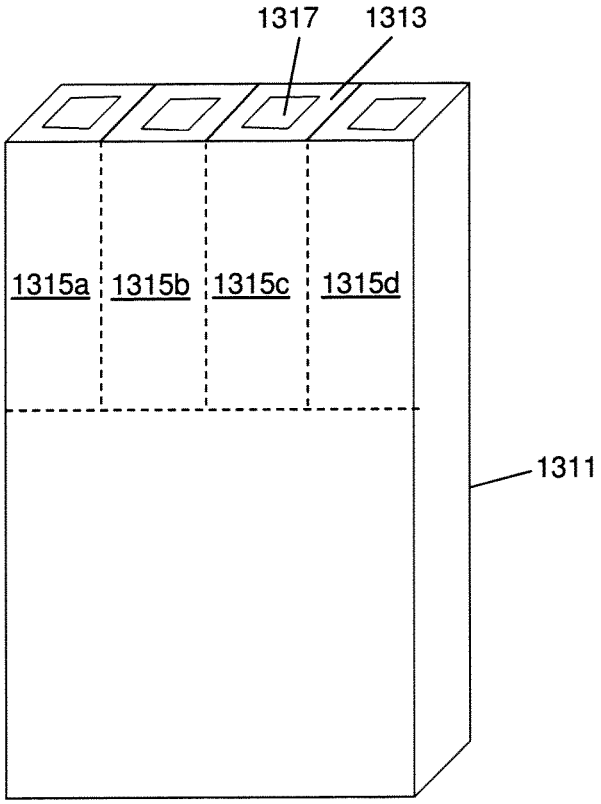
FIG. 13 illustrates an arrayed device in accordance with aspects of the invention.

FIG. 13 illustrates a device in accordance with aspects of the invention. The device of FIG. 13 includes a container 1311. The container includes a plurality of cartridges 1315*a-d* along one end of the container. Each of the cartridges includes a high energy radiation generator, for example as discussed herein, or having features or combinations of features as discussed herein. A top of the container 1313, or tops of the cartridges in some embodiments, includes a window for each cartridge, with a window for cartridge 1315*c* identified by reference numeral 1317. In most embodiments for each cartridge the window is positioned proximate and generally parallel to a membrane within the radiation generating device of the cartridge.

The device of FIG. 13 therefore includes a linear array of high energy radiation generators. The use of an array of high energy radiation generators may be useful for a variety of reasons, including potentially increased magnitudes of radiation in some embodiments. In various embodiments, however, arrays other than simple linear arrays may be used. For example, in some embodiments the array may be in the form of a curved array, with for example elements of the array pointing towards a common focal point in some embodiments and pointing away from a common focal point in other embodiments. Similarly, in some embodiments multiple rows of linear arrays are utilized, for example to provide a planar or two dimensional array, and such an array may also be in the form of a curved surface as well.

Figure 14:
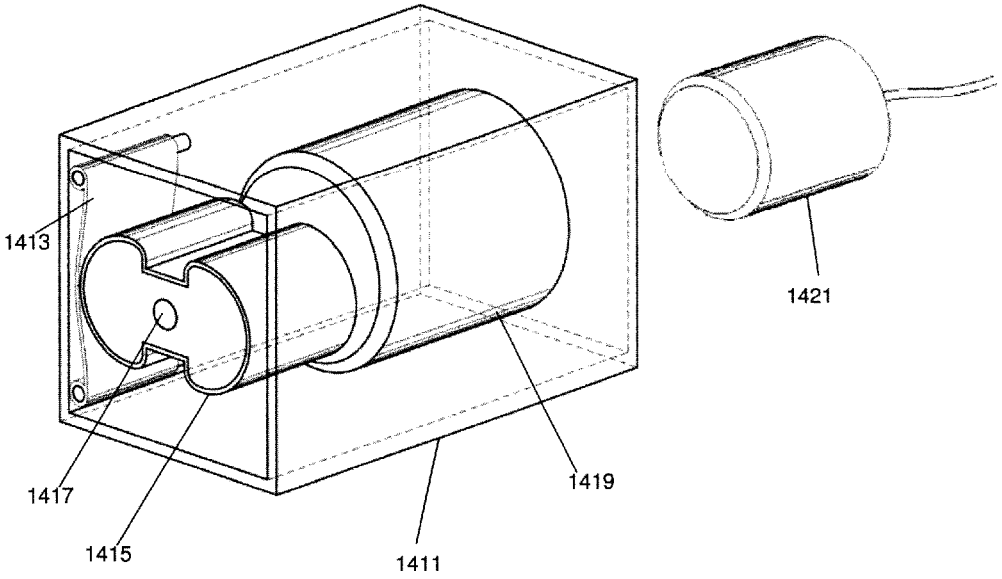
FIG. 14 illustrates a high energy radiation generator with external drive mechanism in accordance with aspects of the invention.

FIG. 14 illustrates a further high energy radiation generator in accordance with aspects of the invention. The device of FIG. 14 is similar to the device of FIG. 1. Accordingly, the device of FIG. 14 has a membrane 1413 positioned to be brushed by lobes of a rotor 1415. The rotor rotates about a spindle 1417, with the membrane and the rotor within a housing 1411. The device of FIG. 14, however, includes a different drive mechanism for the rotor than the device of FIG. 1.

The drive mechanism of the device of FIG. 14 uses a magnetic coupling to cause rotation of the rotor. As illustrated in FIG. 14, a magnetic driver 1421 external to the housing generates a rotating magnetic field, which results in corresponding rotation of magnets or other rotation within a receiver 1419 within the housing. The spindle is coupled to the receiver, and the spindle, and hence the rotor, is caused to rotate by the receiver. The use of such an alternative drive mechanism may be beneficial in maintaining a controlled fluid pressure within the housing.

In some embodiments a receiver may not be provided as a discrete component. In some embodiments, for example, magnets may instead be embedded in or attached to the rotor, with the rotor mounted to a spindle which in turn is coupled to the housing in some embodiments.

Figure 15:
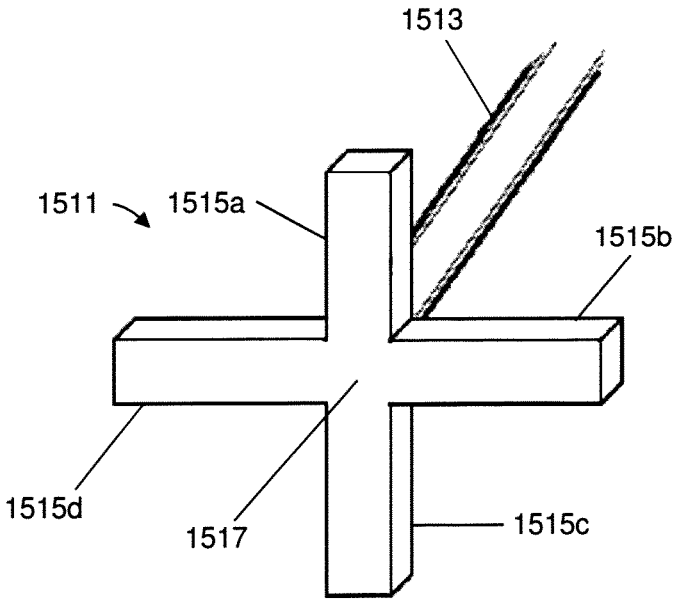
FIG. 15 illustrates portions of a further high energy radiation generator in accordance with aspects of the inventions.

FIG. 15 illustrates a further rotor 1511 in accordance with aspects of the invention, with a spindle 1513 extending from a rear of the rotor to indicate an axis of rotation for the rotor. The rotor includes a plurality of arms 1515 extending from a center area 1517 of the rotor. Faces, for example face 1519, of the arms are intended for use as a contact surface for contacting a membrane of a high energy radiation device such as discussed herein. In various embodiments more than four arms are utilized, and in some embodiments fewer than four arms are utilized. In some embodiments the arms may have a curvature, for example in a plane defined by or parallel to the face of the rotor, and in some embodiments the face of the arms may be curved, for example as is often the case with propellers.

In some embodiments of high energy radiation devices which may make use of the rotor of FIG. 15, a fixed electron target is positioned in the housing behind the rotor, that is with the rotor positioned between the membrane and the electron target. In some embodiments, for example embodiments in which the high energy radiation generator is used as part of an x-ray fluorescence (XRF) device, the electron target may be a sample being subject to measurement. In such embodiments, for example, a sample holder may be used to hold the sample in position behind the rotor. Such positioning of the sample may be beneficial in that electron excited x-ray fluorescence may be used, potentially allowing for greater accuracy of measurement than x-ray excited x-ray fluorescence.

Accordingly, although the invention has been discussed with respect to various embodiments, it should be recognized that the invention comprises the novel and non-obvious claims supported by this disclosure.

What is claimed is:

1. A device useful in generating X-ray radiation, comprising:

a housing including at least one port for at least partially evacuating the housing of atmosphere, at least a portion of the housing being substantially transparent to X-ray radiation;

a first object comprising a first material within the housing, the first material comprising a metal; and a second material within the housing, the second material comprising a polymeric insulator insulated from ground;

at least portions of the first object or at least portions of the second material moveable relative to the other so as to produce a sliding frictional contact between the metal of the first material and the polymeric insulator of the second material; wherein the first object includes at least one metallic surface providing an electron target for generation of X-ray radiation; and wherein the first object comprises a rotor.

2. The device of claim 1, wherein the rotor is moveable relative to the second material so as to produce frictional contact between the rotor and the second material.

3. The device of claim 2, wherein at least portions of the at least one metallic surface of the rotor is on a portion of the rotor moveable to be in frictional contact with the second material.

4. The device of claim 2, wherein at least one of the at least one metallic surface of the rotor is on a portion of the rotor not moveable to be in frictional contact with the second material.

5. The device of claim 4, wherein the at least one of the at least one metallic surface of the rotor provides an electron target for generation of X-ray radiation.

6. The device of claim 2, where the at least one metallic surface comprises at least two metallic surfaces.

7. The device of claim 6, wherein the rotor includes at least two lobes, with a first of the at least two metallic surfaces being on a first of the at least two lobes and a second of the at least two metallic surfaces being on a second of the at least two lobes.

8. The device of claim 7, where the first metallic surface includes a first metal and the second metallic surface includes a second metal, the first metal and the second metal being different metals.

9. The device of claim 1, wherein the rotor includes at least one magnet.

10. The device of claim 9, further comprising a magnetic drive assembly outside the housing.

11. The device of claim 1, further comprising a spindle coupled to the rotor.

12. The device of claim 11, wherein the spindle is coupled to the housing.

13. The device of claim 11, wherein the spindle is coupled to a motor.

14. An X-ray generating device, comprising:

a housing normally sealable so as to provide a controlled fluid pressure environment;

a membrane mounted within the housing; and a rotor rotationally mounted within the housing such that at least a portion of the rotor is configured to slide against at least a portion of the membrane to generate X-rays;

with at least one of the portion of the membrane and the portion of the rotor include a polymeric insulator material insulated from ground and the other of the portion of the membrane and the portion of the rotor include an electrically conductive metal.

15. The device of claim 14, wherein the portion of the rotor includes a portion substantially orthogonal to an axis of rotation of the rotor.

16. The device of claim 15, wherein the rotor includes a face facing towards the membrane, at least a portion of the face positioned to be in sliding contact with the membrane, the face having at least one surface level discontinuity.

17. The device of claim 16, wherein the surface level discontinuity in the face provides a surface away from the portion of the face positioned to be in sliding contact with the membrane.

18. The device of claim 17, wherein the surface below the face includes a metal.

19. The device of claim 18, wherein the surface below the face provides an electron target for generation of X-ray radiation.

20. The device of claim 16, wherein the surface level discontinuity in the face provides a ledge.

21. The device of claim 16, wherein the surface level discontinuity in the face forms a ramp.

22. The device of claim 14, wherein the portion of the rotor includes a portion substantially parallel to an axis of rotation of the rotor.

23. The device of claim 22, wherein the portion of the rotor comprises portions of at least one lobe of the rotor.

24. The device of claim 22, wherein the portion of the rotor comprises portions of at least two lobes of the rotor.

25. The device of claim 24, wherein the portion of the rotor includes at least one metal.

26. The device of claim 24, wherein a first of the at least two lobes includes a first metal and a second of the at least two lobes includes a second metal.

27. The device of claim 24 wherein the at least two lobes comprise at least four lobes.

* * * * *